United States Patent [19]

Carroll

[11] 3,959,618

[45] May 25, 1976

[54] SWITCH ACTUATOR ROCKER HANDLE

[75] Inventor: Thomas D. Carroll, San Jose, Calif.

[73] Assignee: Memorex Corporation, Santa Clara, Calif.

[22] Filed: Nov. 25, 1974

[21] Appl. No.: 526,782

[52] U.S. Cl. ..... 200/339; 74/491; 248/27 R; 200/153 G; 200/330

[51] Int. Cl.[2] ..... H01H 3/20

[58] Field of Search ..... 74/491, 523; 248/27; 200/153 G, 153 T, 329, 330, 331, 332, 338, 339

[56] References Cited

UNITED STATES PATENTS

| | | | |
|---|---|---|---|
| 2,749,400 | 6/1956 | Chickester | 200/153 G |
| 3,229,059 | 1/1966 | Beatty | 74/491 |
| 3,435,169 | 3/1969 | Bienwald | 200/339 |
| 3,712,965 | 1/1973 | Dalton | 200/153 T |

FOREIGN PATENTS OR APPLICATIONS

| | | | |
|---|---|---|---|
| 1,218,578 | 9/1963 | Germany | 200/339 |

*Primary Examiner*—Gerald P. Tolin
*Attorney, Agent, or Firm*—Limbach, Limbach & Sutton

[57] ABSTRACT

A captive pivot nut is fastened to a panel either by a separate bolt or, in the case of a toggle switch, by being threaded onto the switch and a rocker arm is pivotably snapped onto the captive nut and actuates the switch by being pivoted about the nut to depress the switch, or, in the case of a toggle switch, the rocker arm is mounted over the switch toggle arm.

6 Claims, 6 Drawing Figures

SWITCH ACTUATOR ROCKER HANDLE

BACKGROUND OF THE INVENTION

The invention relates to a switch actuator, and more particularly to a rocker handle actuator for a switch.

It is sometimes desirable to provide either a rocker or paddle type handle for actuating a switch. One problem in prior art rocker type switch actuating handles is that the pivot point or fulcrum on which the rocker handle is mounted is an integral part of the switch and requires a slot, guide or bezel to control the location or path of rotation of the rocker arm. This requirement of prior art switch actuator assemblies leads to higher manufacturing and assembling costs when a large number of such switches, as in a control system or a computer, are to be mounted on a panel.

SUMMARY OF THE INVENTION

The above problems of prior art switch actuators are overcome by the present invention of a rocker arm actuator mechanism for a switch comprising a captive nut having a pair of opposed, projecting pivot points and a rocker arm having a pair of opposed, resilient, centrally located side tabs for rotatably gripping the pivot points of the captive nut so that the rocker arm is pivotable about the captive nut to engage with and actuate the switch.

In one embodiment of the invention the captive nut is mounted to a panel by a bolt and the rocker arm is snapped onto the pivot points of the captive nut. The switch is placed within the path of travel of the ends of the rocker arm as it is pivoted about the captive nut so that the pivoting of the rocker arm will depress or otherwise actuate the switch. In another embodiment of the invention, for use with toggle type switches, the captive nut actually mounts the toggle switch to the panel with the toggle arm of the switch projecting through the captive nut. The rocker arm contains a bore or internal sleeve which is fitted over the toggle arm of the switch and the side tabs of the rocker arm are then snapped over the pivot points of the captive nut. As the rocker arm is pivoted about the pivot points of the captive nut it toggles the switch to actuate it.

It is therefore an object of the present invention to provide a reliable, easily assembled switch actuator of the rocker arm type.

It is another object of the invention to provide a rocker handle switch actuator which requires only a circular mounting hole.

It is still another object of the invention to provide a rocker arm switch actuator which functions about a known and mechanically defined pivot point and does not require a slot, guide or bezel to control its location or path of rotation.

The foregoing and other objectives, features and advantages of the invention will be more readily understood upon consideration of the following detailed description of certain preferred embodiments of the invention, taken in conjunction with the accompanying drawings.

DETAILED DESCRIPTION OF CERTAIN PREFERRED EMBODIMENTS OF THE INVENTION

Figure 1:
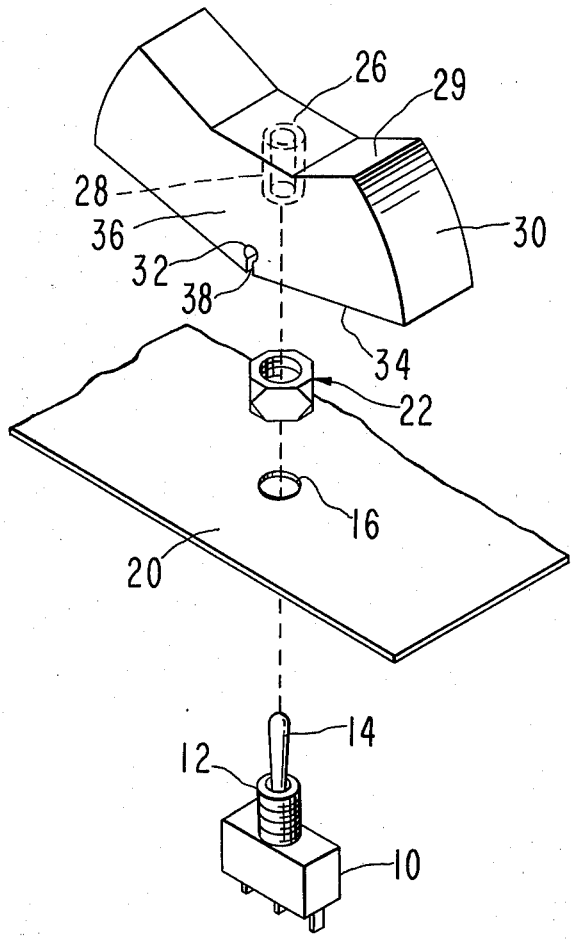
FIG. 1 is an exploded, perspective view of a first embodiment of the invention together with a standard toggle switch.
Figure 4:
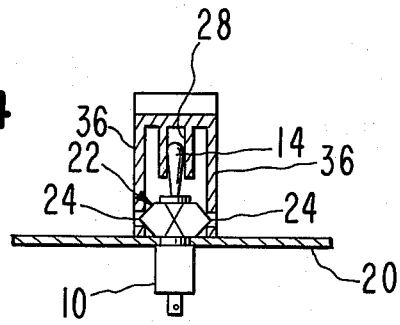
FIG. 4 is an end view, in section, of the embodiment depicted in FIG. 1 when assembled.

Referring now particularly to FIG. 1, a preferred embodiment of the rocker arm actuator mechanism of the invention is depicted in which the projecting threaded portion 12 of a toggle switch 10, having an actuator arm or toggle 14, is inserted through a hole 16 in a panel 20. A captive nut or fastening device 22 is placed over the toggle arm 14 and is threaded onto the projecting portion 12 of the switch 10 which projects through the upper side of the hole 16 in the panel 20, as viewed in FIG. 1. The nut 22 thus clamps the switch 10 against the bottom side of the panel 20 as viewed in FIGS. 1 and 4.

Figure 2:
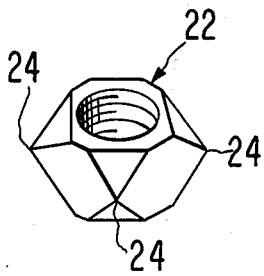
FIG. 2 is a perspective view of the captive nut device for use in the embodiment of FIG. 1.

Referring now more particularly to FIG. 2, it can be seen that the nut 22 is provided with four, diamond-shaped pivot points 24 which project outwardly from the sides of the nut 22 and are arranged at 90° angles with respect to each other as viewed in a horizontal plane, such as the plane defined by the panel 20.

An elongated, rocker arm 26 is provided with an interior, cylindrical bore or sleeve 28 at its center point which is oriented perpendicularly to the plane defined by the panel 20. The sleeve 28 is adapted to receive the projecting toggle 14 of the switch 10 and encase it. The top, end surfaces 29, as viewed in FIG. 1, are angled upwardly from the center of the lever arm 26 to approximate the total movement or throw of a standard toggle or pushbutton type switch during actuation. The rocker arm ends 30 are rounded on a predetermined radius to rotate or rock about a central or pivot axis 32 if the lever arm 26 were placed within a control panel slot or bezel. The bottom surfaces 34 of the lever arm 26 are tapered upwardly from the center at approximately the same angle as the top surfaces 29, as can be more clearly seen in FIG. 6. The lever arm 26 includes a pair of centrally located side tab portions 36 which are integral with the body of the lever arm 26 and are located on the axis 32. The tab portions 36 each include a hole 33 at the intersection of the pivot axis 32 with the rocker arm tabs 36. The holes 33 connect with downwardly extending slots 38. These side tab portions 36 are resilient and are designed to snap fit and be captured by the pivot points 24 of the nut 22. The purpose of the slots 38 is to provide a pathway leading into the holes 33 to simplify assembly of the device.

The four pivot points 24 provide symmetry for using the lever arm 26. The nut surfaces immediately surrounding the opposed pair of pivot points 24 are the only surfaces in intimate contact with the lever arm 26 other than the toggle 14 of the switch 10. Therefore friction is reduced over prior art arrangements. The switch actuator of the invention is easily assembled because, in contrast to prior art assemblies wherein the switch itself is specially constructed to carry the pivot points for the lever arm, the captive nut 22 of the invention is designed to fit all standard toggle switches 10 and is merely threaded onto the projecting portion 12 to clamp the switch 10 against the panel 20. Thereafter the nut 22 need merely be rotated by less than ninety degrees to properly orient the action of the lever arm 26.

Although the lever arm actuator of the invention is adapted to work in a control panel slot or bezel it is not a requirement for operation. The switch actuator of the invention is suitable for use on a flat control panel 20 having only a hole 16 to receive the projecting threaded portion 12 of the switch 10. This further simplifies manufacture and assembly of switch control panels utilizing the switch actuator of the invention.

Figure 3:
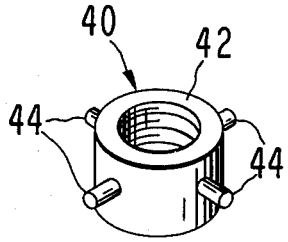
FIG. 3 is a second embodiment of a captive pivot nut for use with the rocker handle depicted in FIG. 1.

Referring now more particularly to FIG. 3, a modified captive nut 40 is depicted in the form of a hollow, interiorly threaded cylinder 42 having four, horizontally projecting, round pivot shafts 44 which are oriented at 90° with respect to each other in a horizontal plane, such as defined by the mounting panel 20. The captive nut of the embodiment depicted in FIG. 3 operates in substantially the same manner as the captive nut depicted in FIG. 2, that is, the holes 33 of the lever arm 26 are snapped over an opposed pair of pivot shafts 44 of the nut 40 which is threaded onto a switch 10 or is mounted in the manner to be described in reference to FIGS. 5 and 6.

Figure 5:
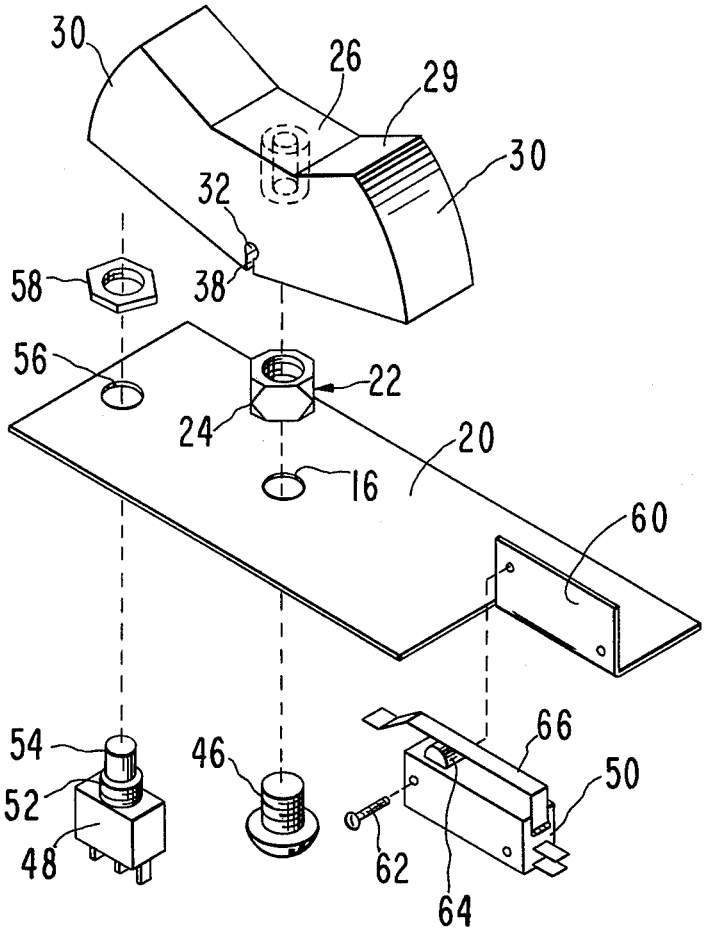
FIG. 5 is an exploded, perspective view of an alternative mounting for the embodiment of FIG. 1.
Figure 6:
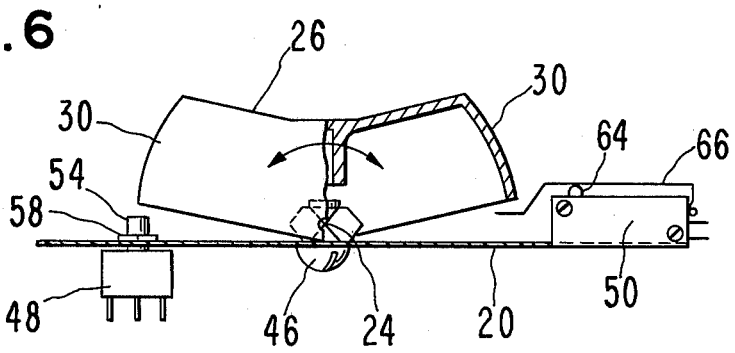
FIG. 6 is a side view in elevation of the embodiment depicted in FIG. 5 when assembled.

Referring now more particularly to FIGS. 5 and 6, an alternative mounting arrangement for the switch actuator of the invention is depicted in which a screw 46 is inserted through the hole 16 from the underside of the panel 20, as viewed in FIG. 5, and is threaded into the captive nut 22. The lever arm 26 is then snapped over the pivot points 24 of the nut 22 in the manner described above in reference to FIG. 1. A pair of switches 48 and 50 are mounted at the opposite ends 30 of the lever arm 26. The switch 48 is of the standard pushbutton type having a projecting, threaded portion 52 and a button type actuator 54. The switch 48 is mounted on the underside of the panel 20 by inserting the projecting portion 52 through a hole 56 in the panel 20 and threading a nut 58 onto the projecting portion 52 from the top side of the panel 20, as viewed in FIG. 5, to clamp the switch 48 to the panel. The location of the hole 56 with respect to the hole 16 is such that the button actuator 54 of the switch 48 resides directly beneath the lefthand end 30, as viewed in FIG. 5, of the lever arm 26.

The end portion of the panel 20 closest to the righthand end of the switch actuator arm 26, as viewed in FIG. 5, has a bent up tab portion 60 on which the switch 50 is side mounted by means of a pair of screws 62. The switch 50 is of the micro switch variety having a button actuator 64 which is depressed by means of a resilient lever 66 fastened at one end to the body of the switch 50. The free end of the lever 66 is situated directly under the right end 30 of the lever arm 26 as viewed in FIGS. 5 and 6.

When the lever arm 26 is pivoted about the pivot points 24 of the nut 22, as for example in the counterclockwise direction, the left end 30 of the lever arm 26 will depress the button actuator 54 of the switch 48 to operate the switch. When the lever arm 26 is rotated in the clockwise direction, the right end 30 of the lever arm 26 contacts and depresses the lever 66 of the switch 50 thereby, in turn, depressing the button 64 to operate the switch. The terms right, left, clockwise and counterclockwise are as viewed in FIG. 6.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

What is claimed is:

1. An improved rocker arm operating mechanism for a switch of the type having an actuator movable between a first position and a second position for operating the switch and the switch being mounted on a panel, wherein the improvement comprises a nut having a pair of opposed, projecting pivot points, means for mounting the nut on the panel, and a rocker arm having a pair of opposed, resilient, centrally located side tabs rotatably gripping the pivot points of the nut so that the rocker arm is pivotable about the nut and engages with and operates the switch actuator.

2. An improved rocker arm switch actuator operator as recited in claim 1, wherein the means for panel mounting the nut mount it adjacent the switch such that one end of the rocker arm engages the switch actuator to move it between its first and second positions when the rocker arm is pivoted in a predetermined direction about the nut.

3. An improved rocker arm switch actuator operator as recited in claim 1, for use with a switch of the type having a threaded mounting sleeve and the actuator projecting from the threaded sleeve, wherein the improvement comprises the nut being threaded onto the sleeve on the opposite side of the panel from the switch and the rocker arm encasing the projecting actuator of the switch.

4. An improved mechanism for actuating a switch of the type having a toggle arm and for mounting it in a hole in a surface, wherein the improvement comprises a fastening member which fits over the toggle arm and grips the switch to clamp it against the surface, the fastening member having a pair of opposed, projecting, pivot points, and a rocker arm having a bore therein for receiving the toggle arm and a pair of resilient, opposed, centrally located side tabs rotatably gripping the pivot points of the fastening member.

5. An improved mechanism for actuating a switch as recited in claim 4, wherein the fastening member is a nut which is threaded onto the toggle switch.

6. In combination, a panel, a switch mounted on the panel, the switch having an actuator movable between a first and second position for operating the switch, and a rocker arm mechanism for moving the switch actuator between the first and second positions, the rocker arm mechanism comprising a nut having a pair of opposed, projecting pivot points, means for mounting the nut on the panel adjacent the switch, and a rocker arm having a pair of opposed, resilient, centrally located side tabs rotatably gripping the pivot points of the nut so that the rocker arm is pivotable about the nut and engages with and moves the switch actuator.

* * * * *